US007695296B1

(12) United States Patent
Hitchcock et al.

(10) Patent No.: US 7,695,296 B1
(45) Date of Patent: Apr. 13, 2010

(54) ELECTRICAL CONNECTOR WITH LEVER AND CAMMING SLIDE

(75) Inventors: Matthew Bryan Hitchcock, Harrisburg, PA (US); Galen M Martin, Camp Hill, PA (US); Ryan Hetrick, Bressler, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/386,600

(22) Filed: Apr. 21, 2009

(51) Int. Cl.
*H01R 13/62* (2006.01)

(52) U.S. Cl. ..... 439/157; 439/347; 439/372

(58) Field of Classification Search ..... 439/157, 439/347, 372
See application file for complete search history.

(56) References Cited

U.S. PATENT DOCUMENTS 5,478,251 A 12/1995 Jaklin
5,518,412 A * 5/1996 Larabell ..... 439/157
5,593,309 A 1/1997 Post et al.
5,618,194 A 4/1997 Maue et al.
6,572,391 B2 * 6/2003 Mochizuki et al. ..... 439/157
6,960,090 B2 11/2005 Denter et al.
6,997,725 B2 * 2/2006 Stella et al. ..... 439/157
7,568,925 B2 * 8/2009 Ciriello et al. ..... 439/157

FOREIGN PATENT DOCUMENTS

EP 0 273 999 B1 9/1993

* cited by examiner

*Primary Examiner*—Gary F. Paumen

(57) ABSTRACT

An electrical connector assembly is disclosed having a housing assembly, having a mating face where at least one camming slide slides relative to the housing assembly, and has a camming slot therein is cooperable with a camming lug on a mating housing. The slide comprises gear rack teeth thereon. A rotary gear is rotatable relative to the housing assembly and includes gear teeth which cooperate with the gear rack teeth. A lever is rotatable relative to the housing assembly and is profiled to rotate the rotary gear, and in turn translate the slide. The housings are drawn together and apart upon movement of the slide.

20 Claims, 7 Drawing Sheets

ELECTRICAL CONNECTOR WITH LEVER AND CAMMING SLIDE

RELATED APPLICATION

The subject disclosure is related to Applicants file E-AV-00630 filed on even date as Ser. No. 12/386,621, the subject matter of which is incorporated herein by reference.

BACKGROUND OF THE INVENTION

The subject disclosure relates generally to an electrical connector assembly having an actuation system to effect mating engagement of two connector halves.

Connector arrangements may have a plug housing, a socket housing, and an actuation means for moving one of the housings into engagement with the other housing such that receptacle contacts of the socket housing are electrically connected to pluggable contacts of the plug housing. These types of plug connector arrangements are primarily used in cases where one of the housings is fixed and accessibility to the plug connector arrangement is limited. These types of conditions typically exist, for example, in the automotive sector, for example in a door-to-body application.

In order to save space, the moveable housing is formed so that only a small portion of the moveable housing projects from the fixed housing when the housings are engaged. This configuration causes the disengagement of the moveable housing from the fixed housing to be difficult. A problem also exists in that the plug connector arrangement has a large number of contact elements that exert a high normal contact force such that considerable force is required to plug-in and release the moveable housing from the fixed housing.

In order to resolve these problems, plug connector arrangements have been provided with actuation systems including actuation camming slides. The actuation slides are arranged on the movable housing and are displaceable in a direction transverse to a direction of engagement. For example, the camming slides may be provided with camming slots that engage with cam projections on the fixed housing. Movement of the movable housing toward the fixed housing can be performed by displacement of the actuation slides transversely with respect to the direction of the movement of the moveable housing toward the fixed housing. In another example, an actuation slide means may be constructed as a toothed rack wherein the displacement of the moveable housing is forced by rotary movement of a pivotal lever with a pinion region engaging in the toothed rack. Examples of such actuation slides are taught by European Patent No. 0 273 999 B1 and U.S. Pat. Nos. 5,478,251; 5,593,309; 5,618,194 and 5,660,556. The actuation slide may be actuated by a lever as shown in U.S. Pat. No. 6,960,090.

In some configurations, given the number of contacts and the mating force to bring the two connectors together, these actuation slides are not effective for the mating engagement. Furthermore, the slides themselves, or the levers require significant open space around them for full travel, which may be an issue with packaging, installation or operation.

It is therefore desirable to develop a plug connector arrangement which can be pushed together and released in a simplified and secured manner while at the same time maintaining low manufacturing costs and saving space.

SUMMARY OF THE INVENTION

The objects were accomplished by providing an electrical connector assembly comprising a housing assembly, having a mating face, and at least one slide slidably movable relative to the housing assembly. The at least one slide assembly has a first actuation member thereon cooperable with a mating housing, such that the housings are drawn together and apart upon movement of the slide. The slide further comprises a second actuation member thereon. A rotary member is rotatable relative to the housing assembly and includes a third actuation member which cooperates with the second actuation member upon rotation thereof to move the slide, and a fourth actuation member radially spaced from a center of rotation of the rotary member. A lever is rotatable relative to the housing assembly and includes a fifth actuation member, which cooperates to rotate the rotary member, and translate the slide, upon rotation of the lever.

In another embodiment of the invention, an electrical connector assembly comprises a housing assembly having a mating face; at least one slide slidably movable relative to the housing assembly, the at least one slide assembly having a camming slot therein cooperable with a camming lug on mating housing, such that the housings are drawn together and apart upon movement of the slide, the slide further comprising gear rack teeth thereon; a rotary gear being rotatable relative to the housing assembly and including gear teeth which cooperate with the gear rack teeth upon rotation thereof to translate the slide, and an actuation member radially spaced from a center of rotation of the rotary member; and a lever being rotatable relative to the housing assembly and profiled for engagement of the actuation member, which cooperates to rotate the rotary member, and translate the slide, upon rotation of the lever.

In yet another embodiment of the invention, an electrical connector assembly, comprises a housing assembly, having a mating face; at least one camming slide slidably movable relative to the housing assembly, the at least one slide assembly having an actuation member thereon cooperable with a mating housing, such that the housings are drawn together and apart upon movement of the slide; a lever being rotatable relative to the housing assembly; and a mechanical advantage multiplier between the lever and the at least one camming slide to provide a compounding of the mechanical advantage of the lever and camming slide, whereupon rotation of the lever cooperates to activate the mechanical advantage multiplier and to translate the slide.

DETAILED DESCRIPTION OF THE EMBODIMENTS

Figure 1:
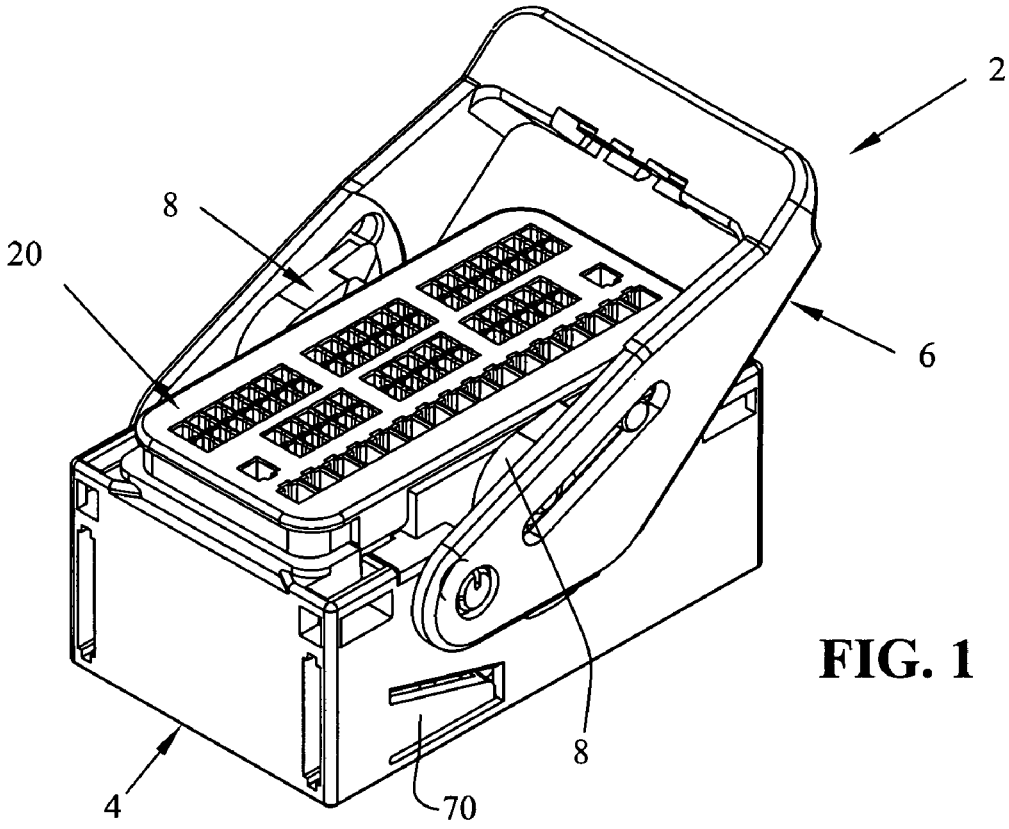
FIG. 1 is a top perspective view of the connector assembly of the present invention.
Figure 2:
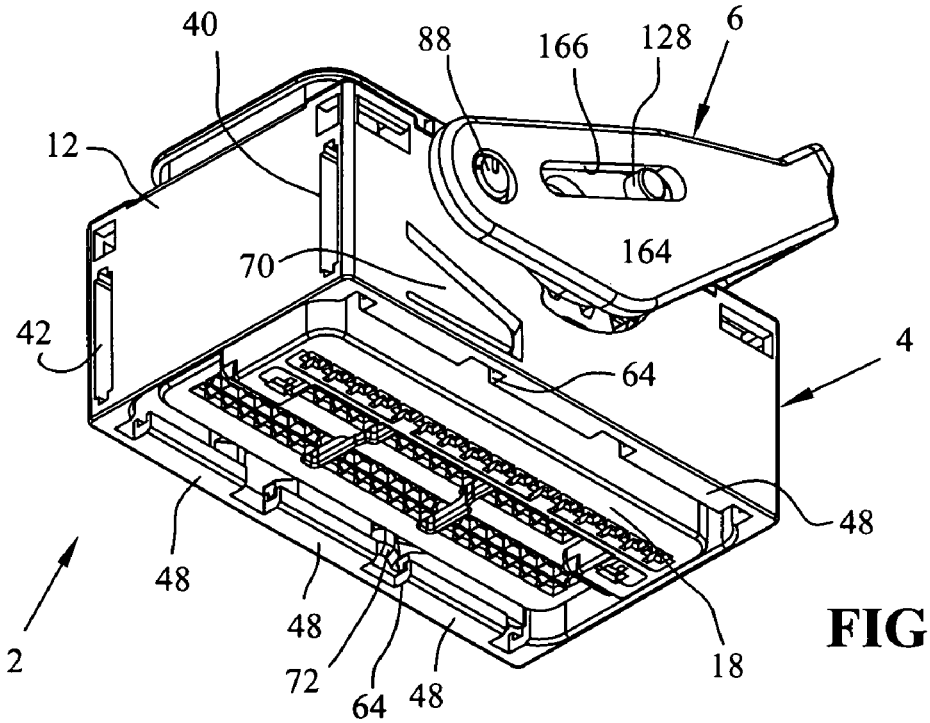
FIG. 2 is a bottom perspective view of the connector assembly shown in FIG. 1.
Figure 3:
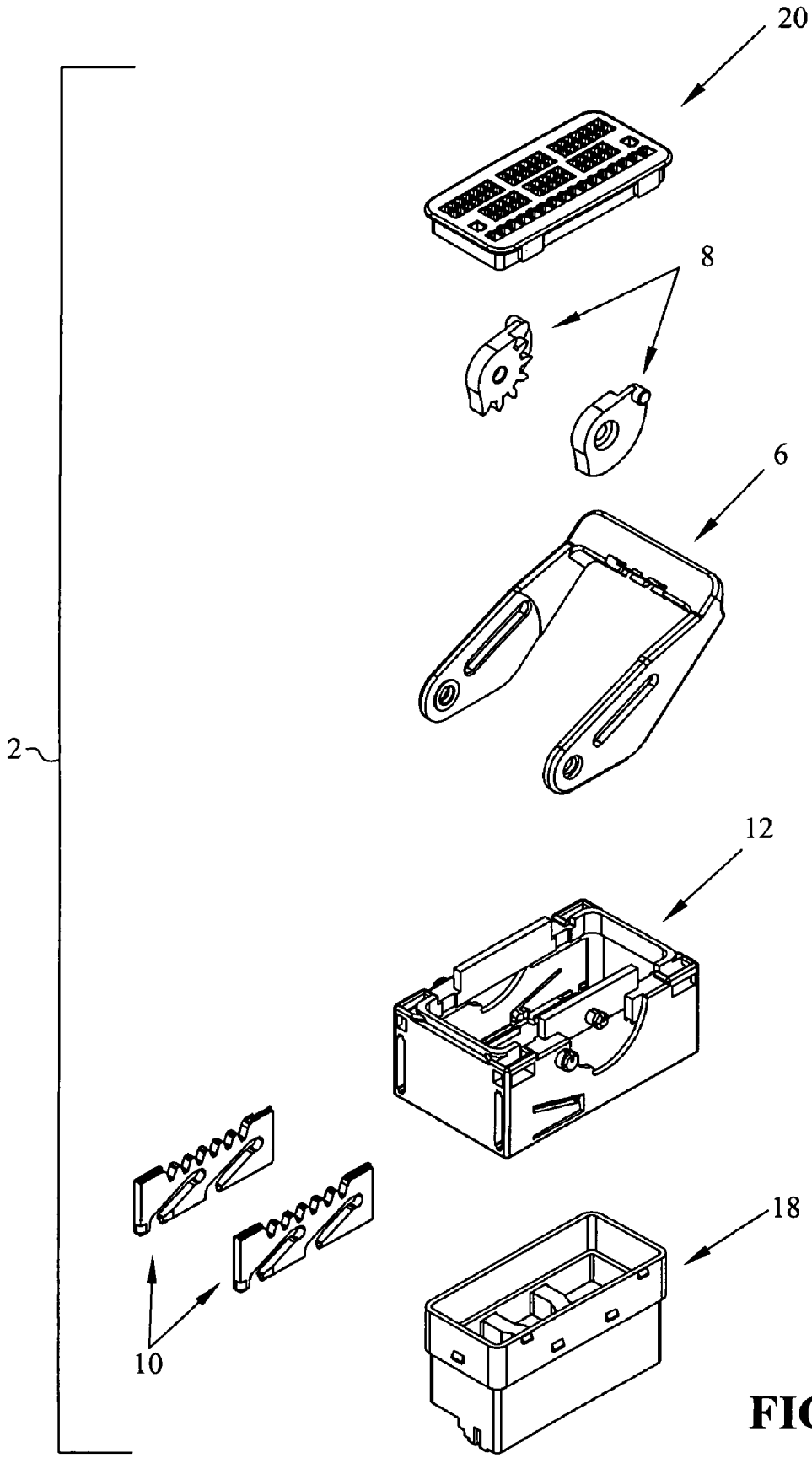
FIG. 3 is a perspective view showing the components of the connector assembly of FIG. 1 exploded away from each other.

With reference first to FIGS. 1-3, an electrical connector assembly 2 is shown as comprised of a housing assembly 4, a lever 6, rotary gears 8, and as best shown in FIG. 3, camming slides 10. With reference now to FIG. 3, the various components are shown in an exploded view, where the housing assembly 4 would comprise a central housing portion 12, a front housing portion 18, and a retaining cap 20. It should be appreciated that connector assembly 2 is profiled to mate with a mating connector having lugs which engage with the camming slides 10, to draw the connector assembly 2 and the mating connector into a fully mated position.

Figure 5:
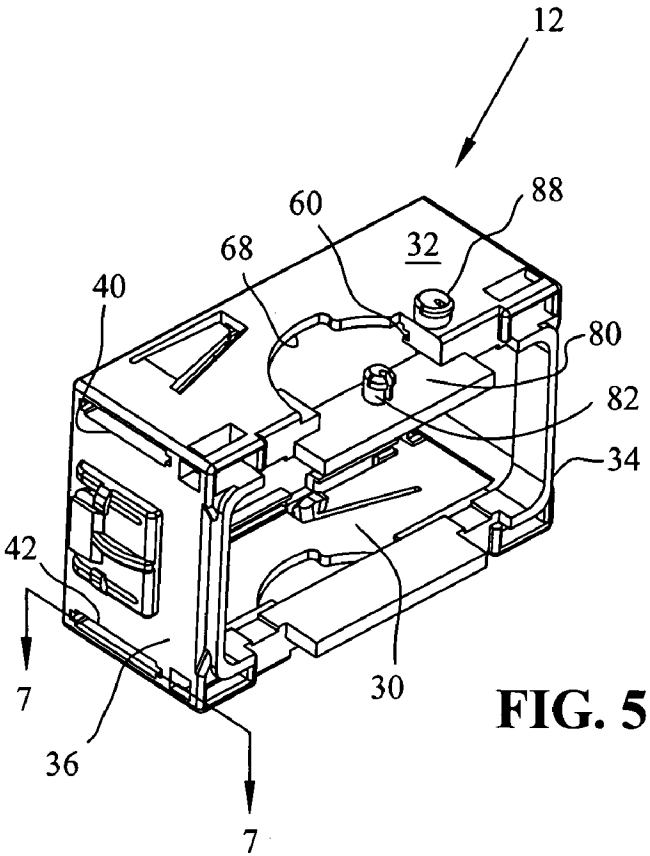
FIG. 5 is a top perspective view of the central housing shown in FIG. 3.
Figure 4:
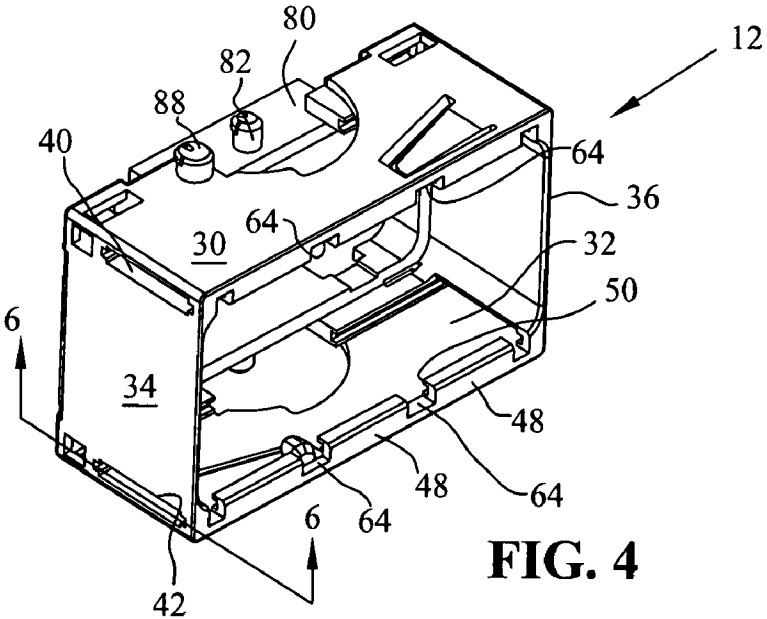
FIG. 4 is a bottom perspective view of the central housing shown in FIG. 3.
Figure 6:
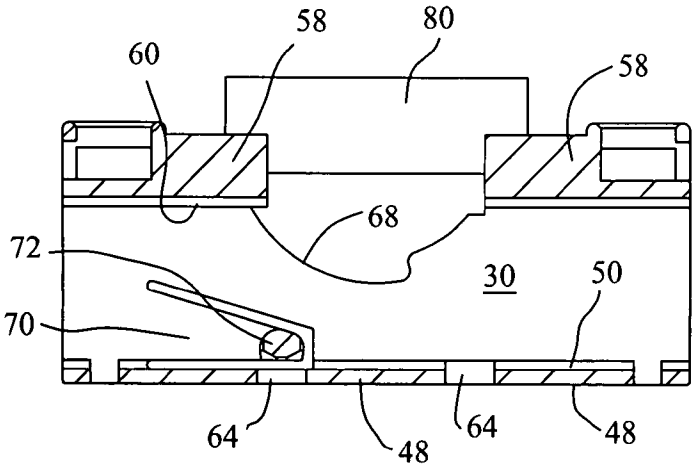
FIG. 6 is a cross-sectional view through lines 6-6 of FIG. 4.
Figure 7:
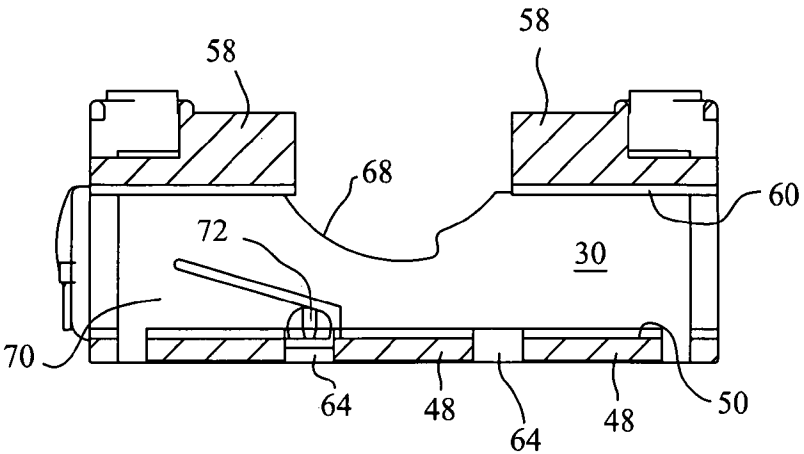
FIG. 7 is a cross-sectional view through lines 7-7 of FIG. 5.

With reference now to FIGS. 4-7, central housing portion 12 will be described in greater detail. Central housing portion 12 includes first and second sidewalls 30, 32 and end walls 34, 36. As shown best in FIGS. 4 and 5, slots 40 and 42 are defined through end walls 34 and 36, and are positionable against an inside of respective sidewalls 30 and 32. With reference to FIGS. 4 and 7, the bottom edge of the sidewalls 30 and 32, include lips 48 having a groove 50 formed therein. As shown in FIGS. 6 and 7, each of the sidewalls 30 and 32 also include upper bars 58 having grooves 60 formed therein. As should be appreciated, slots 40 and 42 is each profiled to receive one of the camming slides 10 (FIG. 3) as will be described further herein.

As shown in FIGS. 4 and 7, lips 48 are separated to define openings at 64. Each sidewall 30, 32 also includes a flexible latch 70 molded therein with a latching lug 72 aligned with one of the openings 64. As shown in FIG. 4, the latching lugs align with diametrically opposed openings 64. As shown best in FIG. 5, each of the side walls 30, 32 also includes a semi-circular recess at 68. A recessed wall 80 is positioned inward of the grooves 50, 60 and spans the semicircular recess 68. The recessed wall 80 includes an integral snap pin at 82 as described herein. Each sidewall 30, 32 further comprises an off-center snap pin at 88, as shown in FIGS. 4 and 5.

Figure 8:
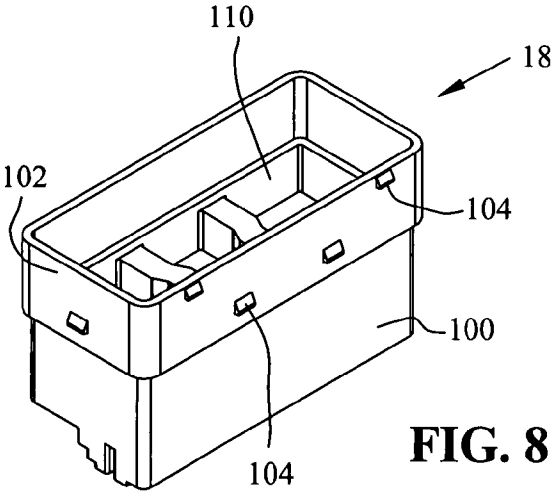
FIG. 8 is a rear perspective view of the front housing portion.
Figure 9:
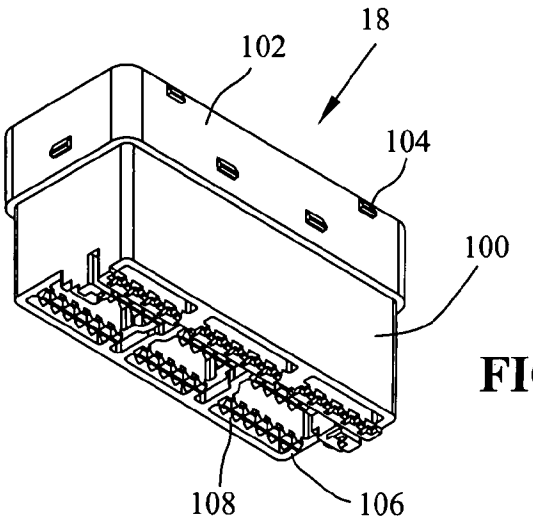
FIG. 9 is front perspective view of the front housing portion.

With reference now to FIGS. 8 and 9, front housing portion 18 will be described in greater detail. Front housing portion 18 includes a housing shroud portion 100 having a skirt 102 with a plurality of latch members 104 to latchingly retain the front housing portion 18 within central housing portion 12. Shroud 100 includes a front mating face 106 having a plurality of terminal receiving cavities 108 for latchingly receiving a plurality of electrical terminals as is known in the art. As shown best in FIG. 8, front housing portion 18 includes an interior 110 to receive the terminals as described above.

Figure 10:
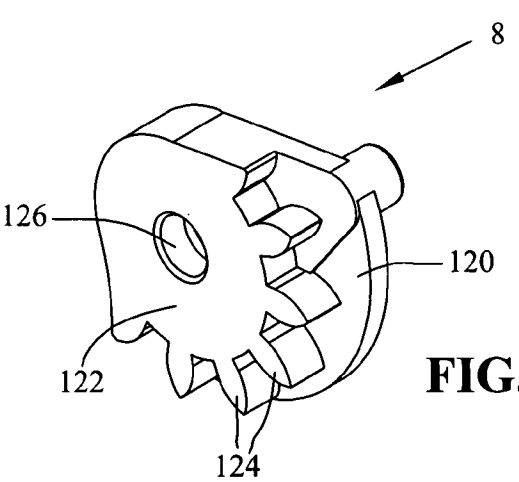
FIG. 10 is a front perspective view of the rotary gear.
Figure 11:
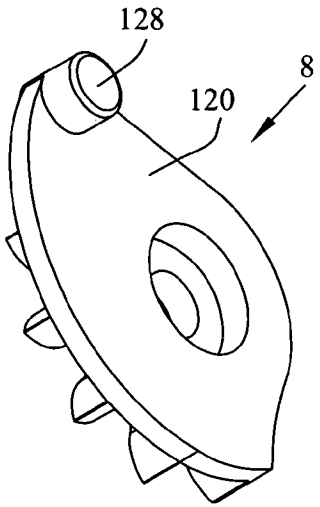
FIG. 11 is a rear perspective view of the rotary gear.

With reference now to FIGS. 10 and 11, rotary gear 8 includes a disk portion 120 and a pinion portion 122 having an actuation member comprised of a plurality of gear teeth 124. Gear teeth 124 are radially disposed about a central axis opening 126. Finally, rotary gear 8 includes a further actuation member in the form of an offset carrier pin 128 provided on the backside of disk portion 120 as will be described herein.

Figure 13:
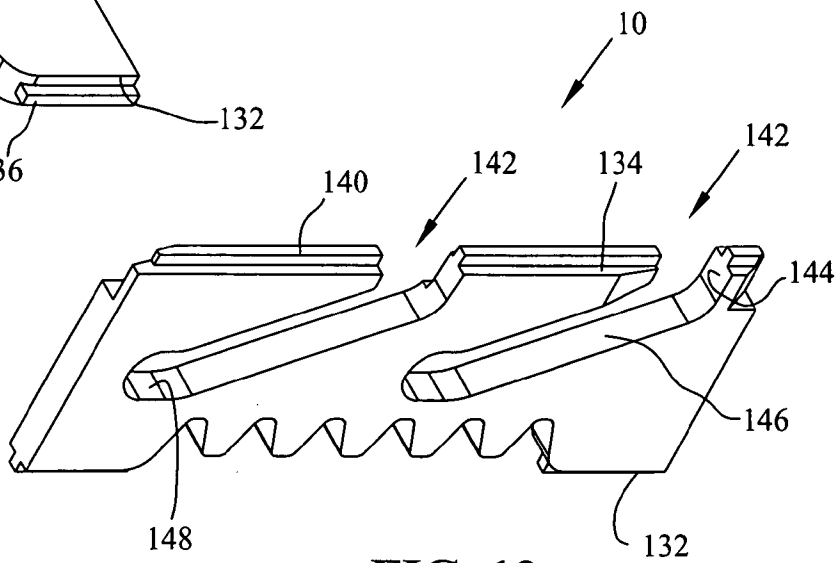
FIGS. 12 and 13 show bottom perspective views of the camming slide.
Figure 12:
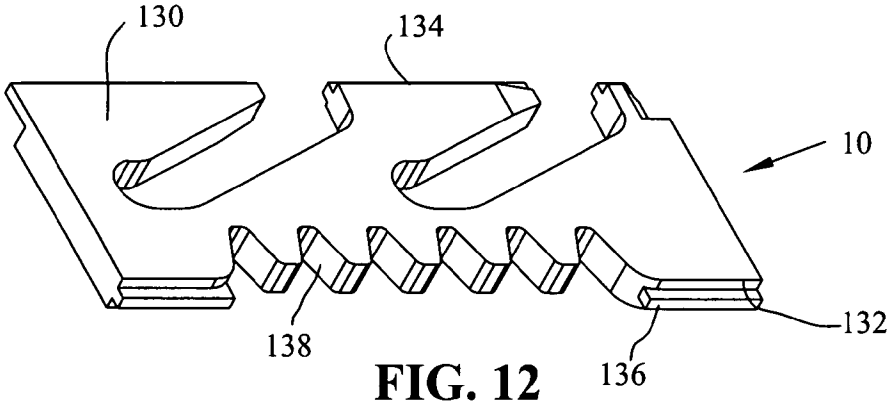

With respect now to FIGS. 12 and 13, camming slide 10 is shown in greater detail. Camming slide 10 is comprised of a rectangular body portion 130 having an upper edge 132 and a lower edge 134. Upper edge 132 includes a tongue 136 and an actuation member in the form of a plurality of rack-type teeth 138 which cooperate with pinion teeth 124 as described herein. As shown best in FIG. 13, lower edge 134 includes a tongue 140 which cooperates with tongue 136 for translation of the slide as described herein. Lower edge 134 also includes actuation members in the form of camming slots 142, where each camming slot includes an entry portion 144, an angled portion at 146 and a lateral end portion 148.

Figure 14:
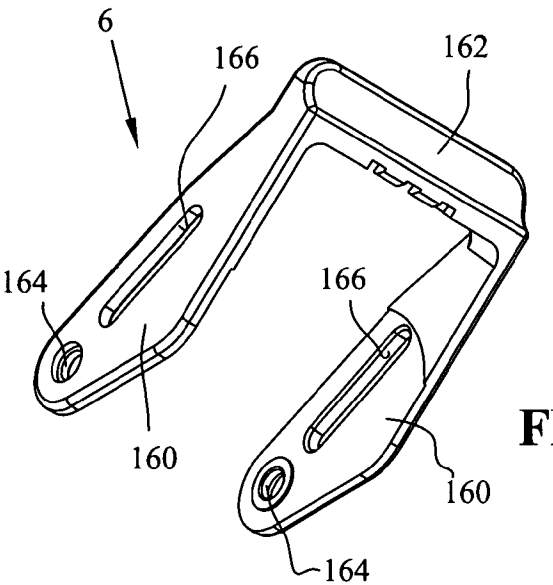
FIG. 14 shows a perspective view of the lever.

With reference now to FIG. 14, lever 6 includes lever arms 160 connected together by way of a lever handle 162. Each of the lever arms 160 includes an aperture 164, profiled to be snap-fitted over snap pin 88, and an actuation member in the form of groove 166 profiled to be received over offset carrier pin 128 as described herein. With the above described elements, the assembly and operation of the connector assembly 2 will be described herein.

It should be appreciated that front housing portion 18 and retaining cap 20 can be snapped in place to central housing portion 12, into the configuration shown in FIGS. 1 and 2. The camming slides 10 may now be received in respective slots 40 and 42 such that the camming slots 142 open downwardly and the respective tongues 136, 140 (FIGS. 12 and 13) may be received in corresponding grooves 50, 60 (FIGS. 6 and 7). This places the camming slides 6 on the inside of sidewalls 30, 32 and aligns the rack teeth 138 (FIG. 12) with the circular opening 68 (FIG. 5). The rotary gears 8 may now be positioned on central housing portion 12, with disk portion 120 residing in the semi-circular recess 68, with the central axis opening 126 (FIG. 10) positioned over snap pin 82 (FIGS. 4 and 5). The rotary gears 8 are assembled to the central housing portion 12 with the offset carrier pins 128 facing outwardly as best shown in FIG. 1. It should be appreciated that the camming slides 10 are mirror images of each other, and that rotary gears 8 are mirror images of each other.

Lever 6 may now be assembled to central housing portion 12 such that apertures 164 (FIG. 14) are positioned over snap pins 88 as best shown in FIG. 1. Lever 6 is positioned onto pins 88 such that the offset carrier pins 128 are positioned within grooves 166. Thus as should be appreciated, rotation of lever 6 causes a rotation of rotary gears 8, which in turn causes meshing between pinion teeth 124 and rack teeth 138 causing a translation of the camming slides 10.

Figure 15:
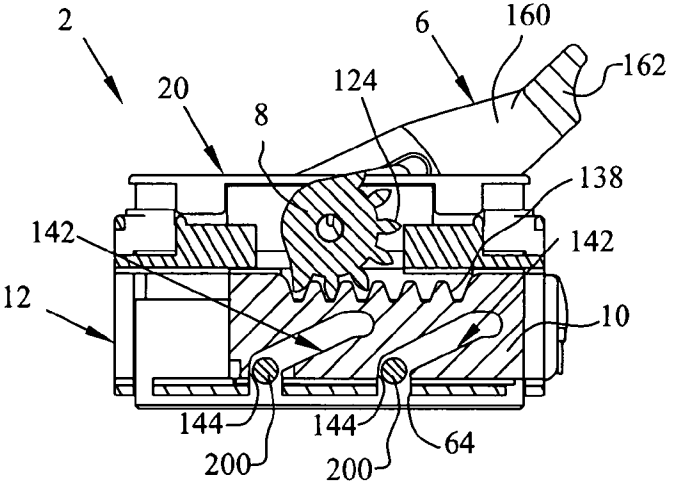
FIG. 15 shows a longitudinal cross-sectional view through the connector assembly at the position of the rotary gear, with the lever in the pre-mated position.

With respect now to FIG. 15, it should be appreciated that rotary gears 8, camming slides 10 and lever 6 are assembled to central housing 12 such that the pre-mated position of lever 6 coincides with the alignment of entry portions 144 of camming slots 142 and openings 64 of central housing portion 12. The lugs incorporated on a mating connector are shown diagrammatically at 200 as being received through openings 64 and into the camming slots 142. At this position, lever 6 may be rotated clockwise in the direction of arrow A in FIG. 16. This rotation causes lever arms 160 to rotate thereby causing a rotation of rotary gears 8 by way of contact between actuation groove 166 (FIG. 2) and offset carrier pins 128 (FIG. 2).

Figure 16:
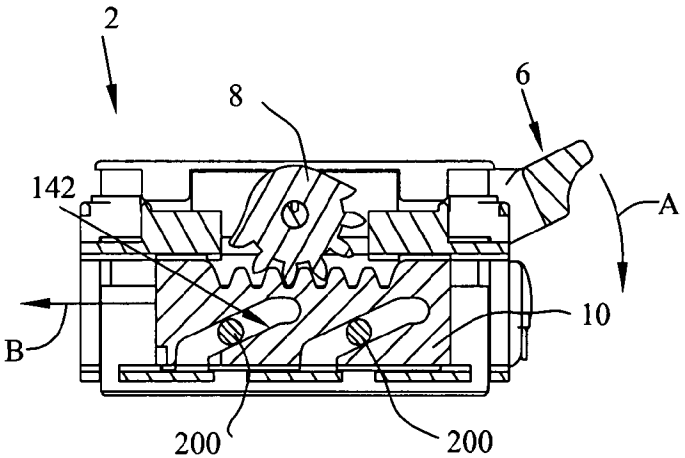
FIG. 16 shows a cross-sectional view, similar to that of FIG. 15 showing the lever being actuated.

The continued rotation of rotary gears 8 in the direction of arrow A in FIG. 16, in turn causes a translation of the camming slides 10 to the left in the direction of arrow B as viewed in FIG. 16, camming the lugs upward into camming slots 142. It should be appreciated to one of ordinary skill in the art that the movement of the lugs 200 into the camming slots 142 causes a drawing together of connector assembly 2 with the mating connector which contains the lugs 200. It should also be appreciated that rotary gears form a mechanical advantage multiplier intermediate the lever 6 and the camming slides 10. Continued rotation of the lever 6 in the direction of arrow A to the position of FIG. 17 causes a full rotation of the rotary gear 8 and a full translation of camming slides 10 to the left as viewed by arrow B, moving the two connector housings into a fully mated position with lugs 200 positioned within the lateral end portions 148 of the camming slots 142.

It should also be appreciated that the latches 70 on central housing portion 12 position latching lugs 72 at diametrically opposed openings 64 as best shown in FIG. 2. Thus when the mating connector which includes lugs 200 is positioned into the configuration of FIG. 15, the latching lugs 72 would engage with the lugs 200 and momentarily retain the two connectors in position, at least until lever 6 is actuated. Thus, the mating connector having lugs 200 could be inserted into the connector assembly 2 with one hand, and lever 6 could be actuated without requiring two hands to make the final connection. Latching lugs 72 also engage the entry portions 144 of cam slides 10 thereby holding the cam slides 10 in the position shown in FIG. 15.

Figure 17:
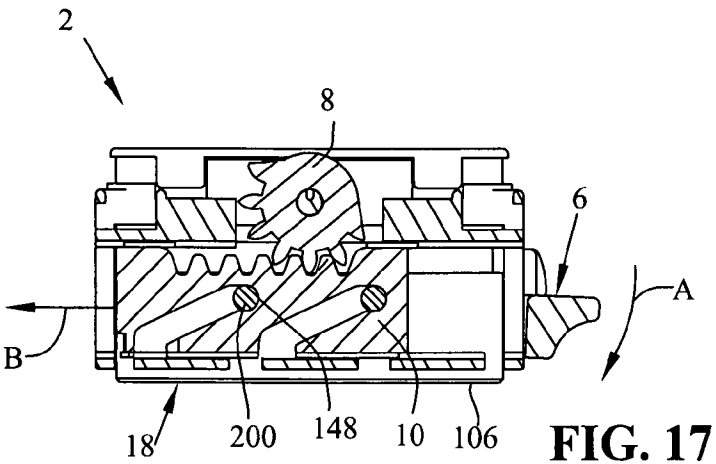
FIG. 17 shows a cross-sectional view similar to that of FIG. 15 in the fully actuated position.

The extreme positions of lever 6 are shown in FIGS. 15 and 17. In FIG. 15, handle 162 of lever 6 is positioned adjacent to retaining cap 20; and in FIG. 17, handle 162 of lever 6 is positioned adjacent to front mating face 106 of front housing 18.

What is claimed is:

1. An electrical connector assembly, comprising:

a housing assembly, having a mating face;

at least one camming slide slidably movable relative to the housing assembly, the at least one slide having a first actuation member thereon cooperable with a mating housing, such that the housing assembly and a mating connector are drawn together and apart upon movement of the camming slide, the camming slide further comprising a second actuation member thereon;

a rotary member being rotatable relative to the housing assembly and including a third actuation member which cooperates with the second actuation member upon rotation thereof to move the slide, and a fourth actuation member radially spaced from a center of rotation of the rotary member;

a lever being rotatable relative to the housing assembly and including a fifth actuation member, which cooperates with the fourth actuation member to rotate the rotary member, and translate the slide, upon rotation of the lever.

2. The electrical connector of claim 1, wherein the first actuation member is comprised of a camming slot.

3. The electrical connector of claim 1, wherein the second actuation member is comprised of rack teeth.

4. The electrical connector of claim 1, wherein the third actuation member is comprised of a pinion portion having gear teeth.

5. The electrical connector of claim 1, wherein the fourth actuation member is comprised of an offset carrier pin.

6. The electrical connector of claim 5, wherein the fifth actuation member is comprised of a groove for receiving the offset carrier pin therein.

7. An electrical connector assembly, comprising:

a housing assembly, having a mating face;

at least one camming slide slidably movable relative to the housing assembly, the at least one slide assembly having a camming slot therein cooperable with a camming lug on a mating housing assembly, such that the housing assembly and a mating connector are drawn together and apart upon movement of the slide, the slide further comprising gear rack teeth thereon;

a rotary gear being rotatable relative to the housing assembly and including gear teeth which cooperate with the gear rack teeth upon rotation thereof to translate the slide, and an actuation member radially spaced from a center of rotation of the rotary member;

a lever being rotatable relative to the housing assembly and profiled for engagement of the actuation member, which cooperates to rotate the rotary member, and translate the slide, upon rotation of the lever.

8. The electrical connector of claim 7, wherein the rotary gear is comprised of an offset carrier pin radially offset from a center of rotation of the rotary gear.

9. The electrical connector of claim 8, wherein the lever is comprised of an actuator groove cooperable with the offset carrier pin.

10. The electrical connector of claim 7, wherein the central housing comprises sidewalls and endwalls, and at least one slot extending through the endwall to receive the at least one camming slide.

11. The electrical connector of claim 10, comprising two camming slides with two slots extending through the endwalls to receive the camming slides.

12. The electrical connector of claim 11, wherein the slots extend along an inside face of the sidewalls.

13. The electrical connector of claim 11, wherein the camming slots on the camming slides comprise entry portions adjacent to a mating face of the housing assembly to receive the camming lugs on the mating connector.

14. The electrical connector of claim 12, wherein the housing assembly includes latches positioned adjacent to the entry portions, and are profiled to latch with the camming lugs on the mating connector.

15. An electrical connector assembly, comprising:

a housing assembly, having a mating face;

at least one slide slidably movable relative to the housing assembly, the at least one slide assembly having an actuation member thereon cooperable with a mating housing, such that the housing assembly and a mating connector are drawn together and apart upon movement of the slide;

a lever being rotatable relative to the housing assembly; and a mechanical advantage multiplier between the lever and the at least one slide to provide a compounding of the mechanical advantage, whereupon rotation of the lever cooperates to activate the mechanical advantage multiplier and to translate the slide.

16. The electrical connector of claim 14, wherein the mechanical advantage multiplier is comprised of a rotary gear being rotatable relative to the housing assembly.

17. The electrical connector of claim 15, wherein the rotary gear is actuable by way of the lever.

18. The electrical connector of claim 16, wherein the rotary gear comprises a pinion portion, and the slide actuation member is comprised of gear rack teeth cooperable with the pinion portion.

19. The electrical connector of claim 17, wherein the rotary gear comprises an offset carrier pin, and the lever includes lever arms having grooves, the offset carrier pins cooperating within the grooves.

20. The electrical connector assembly of claim 15, wherein in a pre-mated position the lever is adjacent a rear of the housing assembly and in a fully mated position, the lever is positioned adjacent to a mating face of the housing assembly.

* * * * *